US008678326B2

(12) United States Patent
Vito

(10) Patent No.: US 8,678,326 B2
(45) **Date of Patent: *Mar. 25, 2014**

(54) ADJUSTABLE GOLF BAG STAND

(76) Inventor: Richard C. Vito, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/309,061

(22) Filed: Dec. 1, 2011

(65) Prior Publication Data

US 2012/0074269 A1 Mar. 29, 2012

Related U.S. Application Data

(63) Continuation of application No. 11/536,945, filed on Sep. 29, 2006, now Pat. No. 8,087,622.

(51) Int. Cl.
*A63B 55/00* (2006.01)

(52) U.S. Cl.
USPC ..... 248/96; 248/95; 248/97; 248/346.01; 248/346.03

(58) Field of Classification Search
None
See application file for complete search history.

(56) References Cited

U.S. PATENT DOCUMENTS

| | | | | |
|---|---|---|---|---|
| 2,851,235 | A * | 9/1958 | Henig | 410/44 |
| 3,573,728 | A * | 4/1971 | Kolankowsky et al. | 714/764 |
| 3,590,752 | A * | 7/1971 | De Pew | 108/55.3 |
| 5,452,773 | A * | 9/1995 | Hrupka | 180/216 |
| 5,887,962 | A * | 3/1999 | Tsai | 312/351.9 |
| 6,231,034 | B1 * | 5/2001 | Walker et al. | 269/17 |
| 6,584,723 | B2 * | 7/2003 | Elmore | 43/4.5 |
| 7,137,602 | B2 * | 11/2006 | Carpenter | 248/96 |
| 7,273,197 | B1 * | 9/2007 | Huggins et al. | 248/154 |
| 8,047,751 | B2 * | 11/2011 | Powers et al. | 410/20 |
| 8,087,622 | B2 * | 1/2012 | Vito | 248/96 |
| 2004/0118031 | A1 * | 6/2004 | Nielson | 43/21.2 |
| 2005/0178932 | A1 * | 8/2005 | Carpenter | 248/96 |

* cited by examiner

*Primary Examiner* — Amy J Sterling
(74) *Attorney, Agent, or Firm* — Rader, Fishman & Grauer PLLC

(57) ABSTRACT

A golf bag support for releasably retaining a golf bag having a longitudinal axis includes a base, a foot, and a pair of arms. The base has a bottom for contacting a surface. The foot is connected to the base and movable between a first position and a second position, the second position arranging the foot to stabilize the base on the surface. The pair of arms extends from the base. The arms are spaced from each other to define a seat sized to receive the golf bag. The arms are movable relative to each other.

24 Claims, 3 Drawing Sheets

ADJUSTABLE GOLF BAG STAND

CROSS REFERENCE TO RELATED APPLICATIONS

This application is a continuation of U.S. patent application Ser. No. 11/536,945, filed on Sep. 29, 2006, which is hereby incorporated by reference in its entirety.

BACKGROUND OF THE INVENTION

1. Field of the Invention

The present invention relates to golf bag stands, and more particularly, to an adjustable golf bag stand for retaining a golf bag in the trunk of a vehicle.

2. Description of Related Art

While a number of golfers may be members of a facility at which their golf clubs are stored, a substantial number of golfers transport their clubs to the course for each round of play. Such transportation typically involves loading the clubs into the trunk or rear of a vehicle, driving to the course and unloading the golf bag. However, as golf clubs have a concentration of weight at the club head, the clubs tend to slide from the bag during transportation. As the clubs slide from the back, the heads and shafts tend to contact each other thereby marring or even damaging the clubs.

As the cost of golf equipment has significantly increased in recent years, there is increased incentive to protect and preserve the golf clubs from inadvertent damage during transport.

Therefore, the need exists for a stand that can be disposed in the trunk of a vehicle to retain the golf bag within the vehicle, as well as to maintain the clubs within the golf bag.

BRIEF SUMMARY OF THE INVENTION

The present invention remedies the foregoing needs by providing an adjustable golf bag stand.

According to one aspect of the invention, a golf bag support for releasably retaining a golf bag having a longitudinal axis includes a base, a foot, and a pair of arms. The base has a bottom for contacting a surface. The foot is connected to the base and movable between a first position and a second position, the second position arranging the foot to stabilize the base on the surface. The pair of arms extends from the base. The arms are spaced from each other to define a seat sized to receive the golf bag. The arms are movable relative to each other.

According to another aspect of the invention, a golf bag support for securely retaining a golf bag on a substantially flat surface includes a base, a foot, and a pair of arms. The foot is rotatable relative to the base between a first position in which the foot is contained substantially within base and a second position in which a portion of the foot protrudes from the base. The base and the foot have substantially co-planar bottoms defining a footprint of the golf bag support that is relatively larger in the second position. The pair of arms is attached to the base and the arms are movable relative to each other. The space between the arms defines a seat for receiving the golf bag.

DETAILED DESCRIPTION OF THE INVENTION

Preferred embodiments of the invention will now be described with reference to the accompanying figures.

Figure 1:
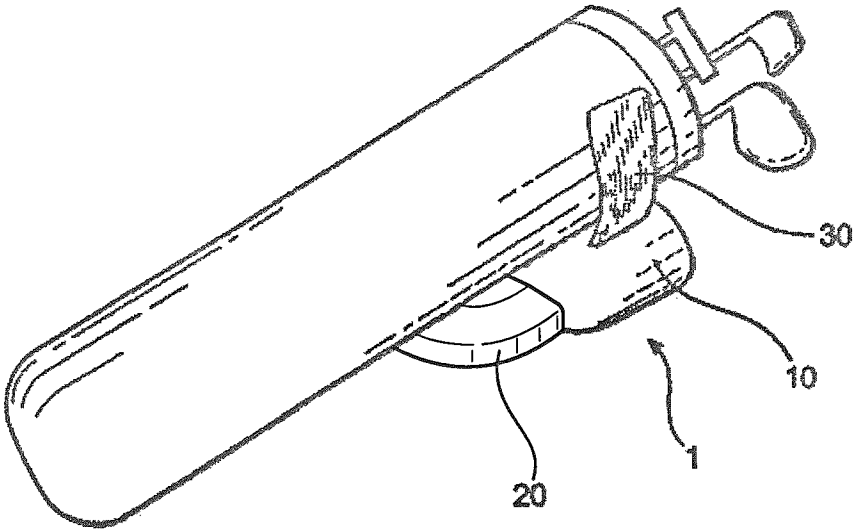
FIG. 1 is a perspective of a golf bag support retaining a golf bag according to a first embodiment of the present invention.

FIG. 1 depicts a golf bag support according to a first embodiment of the present invention. As illustrated therein, a golf bag support generally includes a base 10, a moveable foot 20, and a pair of arms 30.

Figure 2A:
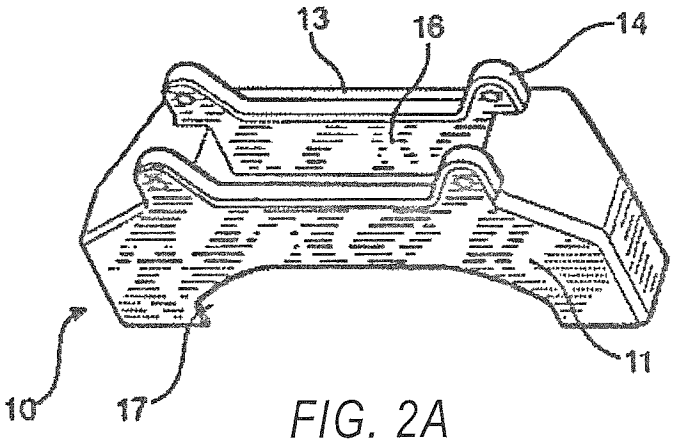
FIGS. 2A and 2B are, respectively, a perspective view and a front plan view of the base of the golf bag support according to FIG. 1.
Figure 2B:
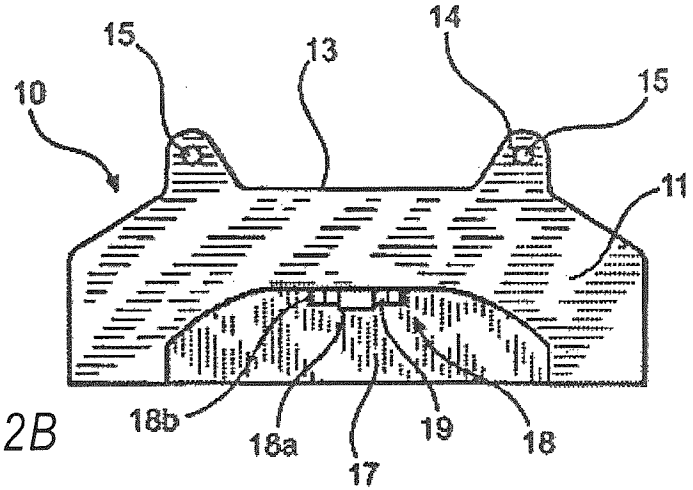

FIG. 2 depicts the base 10. The base 10 has a substantially flat bottom 12 and a substantially flat front face 11 perpendicular to the bottom 12. Accordingly, the base 10 is configured to rest on a flat surface on either the bottom 12 or on the front face 11. The base 10 also preferably includes an attachment point for attaching the arms 30 as will be described in more detail below. In the preferred embodiment, the attachment portion includes a plurality of ears 14 protruding from a top 13 of the base 10. Through-holes 15 preferably are formed in each of the ears 14 for receiving a bolt or similar structure to attach the arms 30. A channel 16 preferably also is formed in the top 13 of the base 10. As shown in FIG. 2, the channel 16 is generally rectangular and the ears 14 are disposed generally adjacent to each of the four corners of the channel 16. The purpose of the channels 16 will be described in more detail below.

The base 10 preferably also includes a recess 17 which, in the preferred embodiment, is an opening formed in both the front face 11 and the bottom 12 of the base 10. The recess 17 generally accepts the foot 20 and is therefore preferably sized and shaped according to the size and shape of the foot. For example, the recess 17 of this preferred embodiment is a generally U-shaped opening in the front face of the base, because the foot 20 (described in more detail below) has a generally U-shaped cross-section.

A mount 18 or similar structure preferably also is provided in the recess 17 to facilitate attachment of the foot 20 to the base 10. The preferred mount 18 includes a generally cylindrical central portion 18*a* that receives a fastener passed through an aperture in the foot 20 and an outer portion 18*b*. A cylindrical groove 19 is formed between the inner portion 18*a* and the outer portion 18*b* of the mount 18 for receiving a portion of the foot 20 therein.

Figure 3:
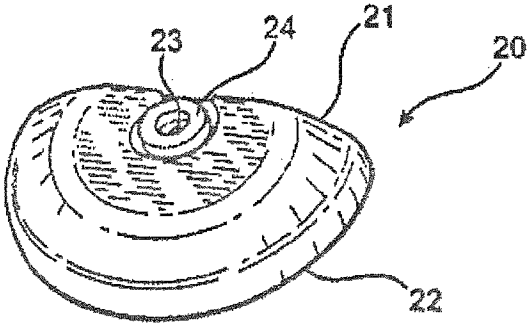
FIG. 3 is a perspective view of the foot of the golf bag support according to FIG. 1.

The foot 20 according to the preferred embodiment will now be described with reference to FIG. 3. The foot 20 preferably is attached to the base 10 to provide added stability to the golf bag support 1 when the base 10 is disposed on its bottom 12 on a flat surface. Moreover, the foot 20 preferably is movable between a first, operating position, in which the foot enlarges a footprint of the golf bag support 1 to provide the aforementioned added stability for the golf bag support, and a second, storing position, in which the footprint of the golf bag support 1 (and more preferably the overall size of the golf bag support 1) is relatively smaller. To this end, the foot 20 preferably includes a flat bottom 22 and a front surface 21 substantially perpendicular to the flat bottom 22. The foot 20 preferably is fastened to the base 10 at the mount 18 of the base 10. More specifically, the preferred foot 20 has a hole 23 through a top thereof and a ring 24 encircling the hole 23 and protruding from the top of the foot 20. The foot 20 is mounted to the base 10 using a screw or similar fastener, which is passed thru the hole 23 and threadably engaged to the central portion 18*a* of the base 10. When so mounted, the ring 24 is received within the groove 19 of the base 10 with clearance between the ring 24 and both the inner portion 18*a* and the outer portion 18*b* of the mount 18. When the foot 20 is so attached to the base 10, the foot 20 is rotatable relative to the base 10 and the fastener.

Figure 5B:
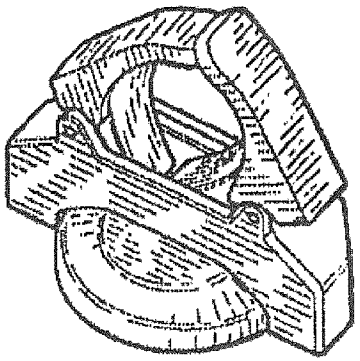
FIGS. 5A and 5B illustrate, respectively, perspective views of a storage position and an operating position of the golf bag support according to FIG. 1.
Figure 5A:
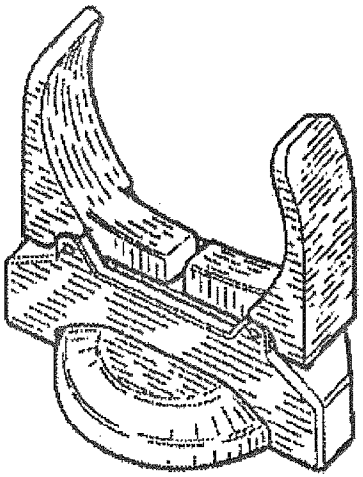
Figure 7:
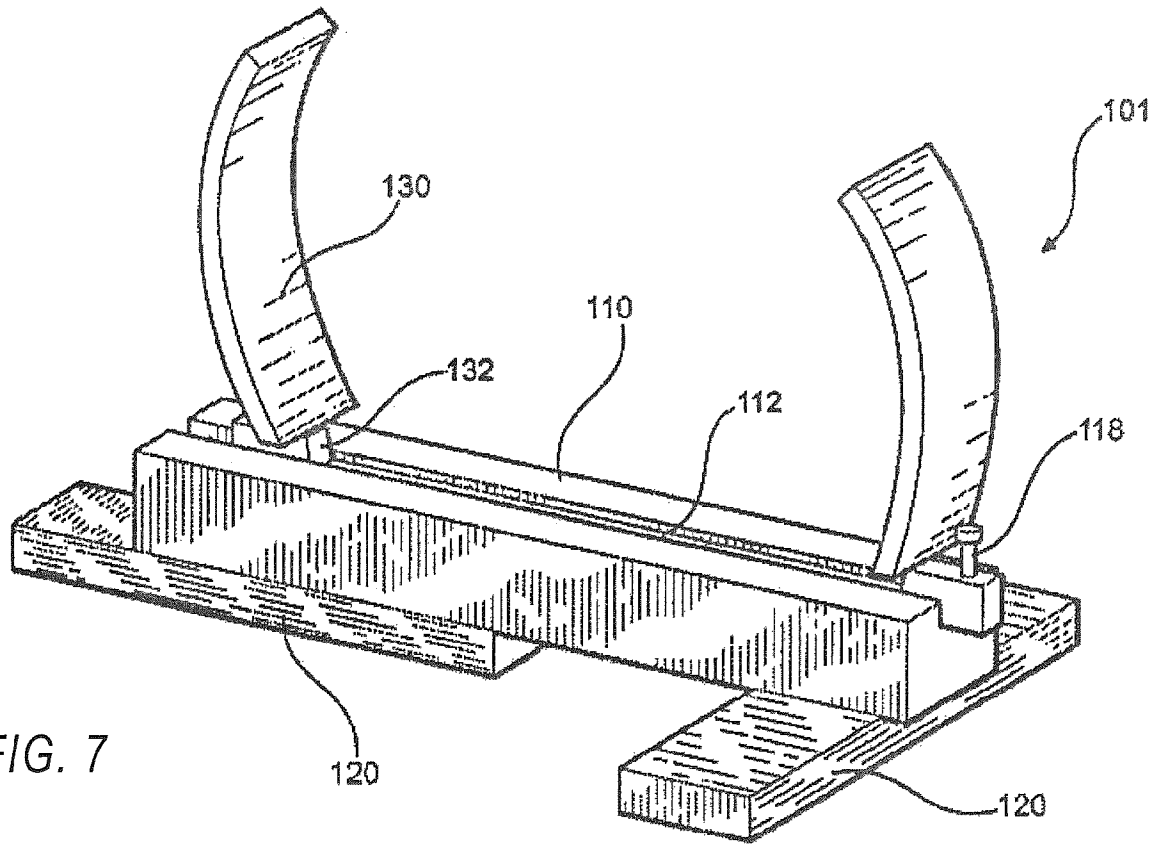
FIG. 7 is a perspective view of a golf bag support according to another embodiment of the preferred invention.

As illustrated, the foot 20 has a generally U-shaped cross-section and is generally disc-shaped. The foot 20 preferably is truncated at the flat front face 21, which is parallel to the axis of rotation of the foot 20. When the foot 20 is rotated relative to the base 10 to the storing position described above, the flat face is preferably arranged to be substantially coplanar with the front face 11 of the base 10. In this manner, the base and foot combination can be laid on a flat surface such that the front face 11 of the base 10 and the face 21 of the foot 20 contact the flat surface. Alternatively, when the foot 20 is relatively rotated approximately 180° from the storing position, i.e., to the operating position, the foot 20 protrudes outwardly from the front face 11 of the base 10. As should be understood, in this operating position, the golf bag support 1 cannot be arranged such that the front face 11 of the base 10 rests on a flat surface. Instead, in the second position, the golf bag support preferably is disposed on a flat surface such that the bottom surface 12 of the base 10 and the bottom surface 22 of the foot 20 contact the substantially flat surface. In the operating position, the golf bag support 1 has improved rigidity on a flat surface because the foot provides the golf bag support 1 with a relatively larger footprint, or area of contact with the substantially flat surface. Of course, as should be understood, if the foot is rotatable through 360° relative to the base 10, an infinite number of positions for the foot relative to the base 10 may be achieved. The operating position and storing position discussed above are shown respectively in FIGS. 5*a* and 5*b*.

Figure 4:
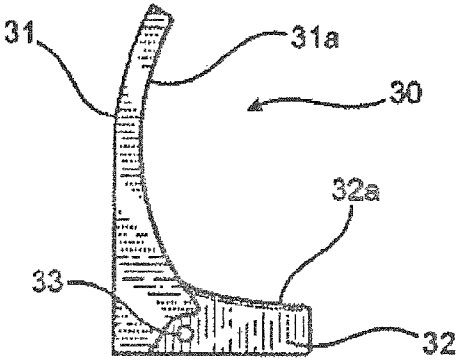
FIG. 4 is a perspective view of an arm of the golf bag support according to FIG. 1.

One of the arms 30 is depicted in more detail in FIG. 4. As illustrated, each arm is generally L-shaped having a longer, side portion 31 and a shorter, bottom portion 32 joined at ends thereof. A through hole 33 is transversely formed through the arm 30 proximate to the area at which the side portion 31 joins the bottom portion 32. In the preferred embodiment, an inner surface 31*a* of the side portion 31 and an inner surface 32*a* of the bottom portion 32 are preferably curvilinear. Moreover, in the preferred embodiment, the bottom portion 32 of the arm 30 preferably is narrower than the side portion 31 of the arm 30.

Two arms preferably attach to the base 10 such that the distal end of the side portion 31 of each arm 30 is directed away from the bottom surface 12 of the base 10. Moreover, the arms are arranged, as shown in FIG. 1, such that the inner surface 31*a* of each side portion 31 faces the inner portion 31*a* of the opposing arm's side portion 31. Preferably, the through hole 33 formed transversely through each side arm is aligned with the holes 15 passing through the ears 14 of the base 10. A bolt or similar fastener is preferably passed through the aligned holes to fasten the arms 30 to the base 10. The bolt preferably also serves as a shaft about which the arms rotate relative to the base 10.

When a pair of arms 30 is disposed on the base 10 as described above, the curvilinear inner surface 31*a* of the side portions 31 of the arms 30 and the inner portions 32*a* of the bottom portions 32 of each arm 30 form an opening or seat for receiving a golf bag. In use, the arms 30 are rotated relatively away from each other to widen the opening, i.e., by moving the distal ends of the side portions 31 of the arms 30 relatively away from each other. When the arms are so moved to widen the opening, the arms rotate about the bolt, and the distal ends of the bottom portion 32 of each arm are displaced relatively upwardly. Accordingly, when the golf bag is placed within the opening defined by the arms 30, the weight of the golf bag forces the bottom portion 32 of each of the arms downwardly, thereby causing the arms to rotate relatively towards each other and "clamp" around the golf bag.

In a preferred embodiment, as illustrated most clearly in FIG. 1, the golf bag is placed such that the portion of the bag proximate the bag's open end (i.e., the end in which golf clubs are received) is placed in the golf bag support 1. As should be appreciated, when the golf bag is supported by the golf bag support in this manner, the end of the bag opposite the opening is resting on the flat surface, thereby setting the bag at an incline. As will be appreciated, this inclined orientation of the bag will result in maintaining the golf clubs in the bag, especially during transport.

As will be appreciated from the foregoing embodiment, the golf bag support is capable of receiving golf bags of varied diameters without the need for any adjustments. Nevertheless, the curvilinear inner surfaces 31*a* of each of the arms is preferably sized and contoured, and the arms preferably are spaced at a distance such that the golf bag stand accommodates a standard-sized golf bag. It is contemplated that the bottom portion 32 of each of the arms 30 will be substantially horizontal when a golf bag is at rest in the golf bag stand. Nevertheless, the bottom portion 32 of each of the arms 30 is preferably sized such that as the arms are rotated relatively near each other, the bottom portion 32 may descend into the channel 16 formed in the top of the base 10. For example, the bottom portion 32 of each of the arms 30 may necessarily be disposed in the channel when a golf bag is placed in the golf bag stand that has a relatively smaller diameter, thus dictating a smaller distance between the distal ends of the side portions 31 of the arms 30.

Figure 6:
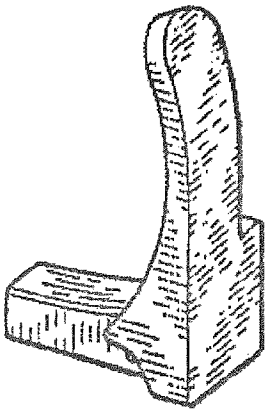
FIG. 6 is an alternate arm for use with a preferred golf bag support.

When the golf bag stand is not in use, the foot preferably is rotated into the first position described above, such that the flat base 21 of the foot 20 is substantially coplanar with the front face 11 of the base 10. Moreover, to further decrease the size of the device when not in use, the arms 30 preferably are rotated relatively closer to each other, thereby reducing the size of the stand. Preferably, the arms are rotated relatively closer to each other such that at least one, but preferably both of the bottom portions 32 of the arms 30 are disposed within the recess 17. In addition, as shown in FIG. 6, each of the arms may have a cut-out 34 to facilitate further rotation of the arms relatively closer to each other. As shown in that figure, the cut-out is preferably slightly wider than half the depth of the side portion 31 of the arm. In this manner, when the arms are rotated toward each other, they may fold over each other. Moreover, this arrangement allows for the use of identical arms 30 for both of the arms. Of course, as would be appreciated by one of skill in the art, other cut-outs or arrangements could be used to allow further rotation of the arms in a direction relatively closer to each other to thereby reduce the overall size of the golf bag stand when not in use.

While the invention has been described to this point in connection with a preferred embodiment, modifications also are anticipated.

For example, the golf bag stand also may incorporate a strap or similar device selectively attaching the distal ends of the side portions 31 of the arms 30. Any number of fasteners, clips and/or adjusters also may be used in connection with the strap, to further secure a golf bag in the golf bag stand 1.

Moreover, although the invention is described wherein a bolt is passed through a through hole 33 in the arm 30 and a through hole 15 in the base 10 to provide both an attachment and a pivot about which the arm rotates relative to the base, other arrangements are anticipated. For example, instead of using through holes, at least one of the base 10 and the arms 30 may include one or more detents or protrusions while the other of the base 10 and the arms 30 includes one or more indents. In this manner, the arms are snap-fit into the base, and the relative rotation is preserved, i.e., because the detent is free to rotate within the indent. By snap fitting the arms 30 into the base 10, there is no need for extra fasteners.

Another embodiment of the invention is depicted in FIGS. 7-10. As illustrated therein, a golf bag stand 101 includes a base (a bridge 110 in this embodiment), a foot 120 connected to the bridge 110, and a pair of arms 130 extending generally upwardly from the bridge 110.

The bridge is generally an elongate member having a longitudinally extending seating channel 112, with a bottom 114 of the seating channel 112 including a plurality of spaced recesses 116.

In this preferred embodiment, each of the arms 130 is adjustably connected to the bridge 110 by disposing a vertically actuated pin 118 relative to the recesses 116 in the bottom of the channel 112. More specifically, the vertically actuated pin 118 is actuated to disengage the recesses such that the associated arm 130 is transversely slidable in the channel 112. When the arm 130 is at a desired position, the pin 118 is actuated to engage a recess 116, thereby locating the arm 130 relative to the bridge 110. It is further contemplated that the bottom of the channel can be formed with a plurality of teeth and that the portion of the arm includes corresponding teeth. In this manner, upon operable engagement of the teeth, further horizontal displacement of the arms 130 relative to the bridge is precluded. When such teeth are used, the arm 130 is moved relative to the channel by lifting the arm vertically such that the corresponding teeth are removed from engagement, locating the arm horizontally, and lowering the arm vertically to then engage the teeth.

The arms 130 preferably have a generally curvilinear profile sized generally to engage the outer portion of a bag retained by the stand. As illustrated, each of the arms preferably includes a root 132 receivable in the seating channel 112. The root 132 can include a pair of projecting pins to engage corresponding grooves within the channel 112, to aid in maintaining orientation of the arm 130 in the channel 112.

In a preferred configuration, the arms 130 preferably also are rotatable relative to the channel between a first, operating position generally transverse to the bridge, and a second, storage position, in which the arms are folded to a position generally adjacent to the bridge. As should be appreciated, the overall size of the golf bag stand is generally reduced when the arms are folded to the storage position—to more easily store the device when not in use.

One or more feet also are provided in this embodiment, generally to provide added stability to the stand when in use. In the illustrated embodiment, two feet are rotatably connected to a bottom of the bridge. The feet are rotatable between a generally parallel storage position and a partially transverse operating position. In one configuration, each foot is rotatably mounted to the bridge such that upon assuming the storage position, the feet are collinear with each other and the bridge.

The feet generally are connected to the bridge using known means, for example, threaded fasteners, and the like. In other contemplated embodiments, the feet may not be rotatable relative to the bridge, but instead may be relatively slidable or hinged. Regardless of the attachment method, the one or more feet preferably are movable between a first, storage position, and a second, operating position. In the operating position, the footprint of the stand is preferably larger than the footprint of the stand in the storage position, to provide added stability to the stand. Of course, the feet may be rigidly, i.e., immovably, attached to the bridge, if it is decided that the feet need not be movable relative to the bridge.

To use the golf bag stand according to this preferred embodiment of the invention, a golfer preferably moves the feet relative to the base into the operating position, i.e., generally transverse to the bridge, and sets the stand on the feet on a flat surface of the trunk, or the like. The feet are preferably then rotated so as to be substantially transverse to the bridge, defining a generally U-shaped seat bounded on the sides by the curvilinear surfaces of the arms and on the bottom by a portion of the bridge intermediate the arms. Preferably, a portion of the golf bag proximate the open end of the golf bag is placed in the seat, i.e., on the portion of the bridge intermediate the two arms, such that an axis of the substantially cylindrical golf bag is generally normal to the channel of the bridge. The arms are then moved relatively closer to each other, e.g., as described above, until the curvilinear surfaces of both arms contact the exterior of the golf bag. Accordingly, the golf bag is contacted by both of the arms, and by the portion of the bridge intermediate the arms.

Typically, the bridge has a length of at least eight inches and typically on the order of fifteen to twenty inches.

Of course, modifications to this embodiment also are contemplated. For example, although a vertically actuated pin is discussed as a mechanism for locating the arms relative to bridge, other known mechanisms would also be known to those of ordinary skill. For example, a ball detent, a pull pin, a set screw, or the like, also may be used to locate the arms relative to the bridge.

Many of the modifications described above with reference to FIGS. 1-6 also may be made to the present embodiment. Moreover, one of ordinary skill in the art also would recognize that many features of the embodiment described with reference to FIGS. 1-6 could also be used in the embodiment described with reference to FIG. 7, and vice versa.

Although the golf bag stand according to the present invention can be formed from any of a variety of materials including metals, composites, alloys and even wood. It is anticipated that a satisfactory material will be a relatively hard or rigid plastic, including thermoplastics, thermosets or thermoplastic elastomers.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

The invention claimed is:

1. A golf bag support for releasably retaining a golf bag, comprising:

a base having a channel; and a pair of arms extending from the base, the arms being spaced from each other to define a seat sized to selectively receive the golf bag, each of the arms being pivotable at the connection point to the base member from an open position to a closed position, wherein each of the arms includes a first member and a second member forming a substantially ninety degree angle with the first member, wherein the second members are sized to fit within the channel and the channel of the base member is configured to receive the second member of the arms when the arms are pivoted away from the open position, wherein each arm defines an interior surface and each of the arms are configured to be moveable about the axis via a joint between the open position and a closed position by force imparted on the interior surface of the second member to move the second member toward the channel.

2. The golf bag support of claim 1, including a foot connected to the base and movable between a first position and a second position, the second position including arranging the foot to stabilize the base on the surface, wherein the foot is rotatable relative to the base between the first position and the second position.

3. The golf bag support according to claim 2, wherein the bottom of the base and a bottom of the foot are generally co-planar and define a footprint of the golf bag support, wherein the size of the footprint differs when the foot is in each of the first position and the second position.

4. The golf bag support according to claim 3, wherein the footprint of the golf bag in the second position is larger than the footprint of the golf bag in the first position.

5. The golf bag support according to claim 1, wherein the first member and second member are integral and define a continuous interior surface.

6. The golf bag support according to claim 1, wherein each arm defines an interior surface facing the interior surface of the other arm and wherein each surface is generally curvilinear.

7. A golf bag support for releasable retaining a golf bag, comprising:

a base having a channel; and a pair of arms extending from the base, the arms being spaced from each other to define a seat sized to selectively receive the golf bag, each of the arms being pivotable at the connection point to the base member from an open position to a closed position, wherein each of the arms includes a first member and a second member forming a substantially ninety degree angle with the first member, wherein the second members are sized to fit within the channel and the channel of the base member is configured to receive the second member of the arms when the arms are pivoted away from the open position , further comprising a foot connected to the base and movable about the axis via a joint between an open position and a closed position by force imparted on the distal ends of the arms.

8. A golf bag support for releasably retaining a golf bag, comprising:

a base having a channel; and a pair of arms extending from the base, the arms being spaced from each other to define a seat sized to selectively receive the golf bag, each of the arms being pivotable at the connection point to the base member from an open position to a closed position, wherein each of the arms includes a first member and a second member forming a substantially ninety degree angle with the first member, wherein the second members are sized to fit within the channel and the channel of the base member is configured to receive the second member of the arms when the arms are pivoted away from the open position, wherein a distal end of each second member is displaced in a position forward of the channel of the base when the arms are spaced from each other in the open position and displaced toward the channel of the base when the arms are pivoted towards each other by the force applied by the placement of the golf bag in the seat.

9. A golf bag support for releasably retaining a golf bag, comprising:

a base having an opening therein; and a pair of arms, each of the pair of arms being substantially L-shaped with a first, relatively longer leg fixed to a second, relatively shorter leg at a joint, the joint of each arm being disposed in the opening in the base such that distal ends of the second legs are arranged proximate each other to define a seat for the golf bag including the second legs on a bottom of the seat and the first legs defining opposite sides of the seat, each of the arms being pivotable at the joint, the arms being configurable in an open position, in which the distal ends of the second legs are disposed above the base and distal ends of the first legs are spaced relatively farther apart, and a closed position, in which the distal ends of the second legs are disposed within the opening in the base and the distal ends of the first legs are spaced relatively closer, the arms being movable from the open position to the closed position by a force imparted on the distal ends of the second legs by a golf bag placed in the seat.

10. The golf bag support of claim 9 wherein the base has at least two ears and the arms are pivotally attached to the ears of the base.

11. The golf bag support of claim 9 wherein the first member and second member are integral and define a continuous interior surface.

12. The golf bag support according to claim 9, further comprising a foot connected to the base and movable about the axis via a joint between an open position and a closed position by force imparted on the distal ends of the arms.

13. A golf bag support for releasably retaining a golf bag, comprising:

a base having a central opening therein and at least one attachment ear; and a pair of arms pivotally attached to the base, each of the pair of arms being substantially L-shaped with a first, relatively longer leg integral with a second, relatively shorter leg wherein the first and second legs define a continuous curvilinear interior surface on each arm such that the interior surface of the first arm faces the interior surface of the other arm, the arms spaced from each other to define a seat sized to selectively receive the golf bag, each of the arms configured to be pivoted by a force imparted on distal ends of the arms between an open position where the distal ends of the arms are spaced relatively farther apart and a closed position where the distal ends of the arms are moved into closer proximity.

14. The golf bag support according to claim 13, wherein the arms are plastic.

15. The golf bag support of claim 7, including a foot connected to the base and movable between a first position and a second position, the second position including arranging the foot to stabilize the base on the surface, wherein the foot is rotatable relative to the base between the first position and the second position.

16. The golf bag support according to claim 15, wherein the bottom of the base and a bottom of the foot are generally co-planar and define a footprint of the golf bag support, wherein the size of the footprint differs when the foot is in each of the first position and the second position.

17. The golf bag support according to claim 15, wherein the footprint of the golf bag in the second position is larger than the footprint of the golf bag in the first position.

18. The golf bag support according to claim 7, wherein the first member and second member are integral and define a continuous interior surface.

19. The golf bag support according to claim 7, wherein each arm defines an interior surface facing the interior surface of the other arm and wherein each surface is generally curvilinear.

20. The golf bag support of claim 8, including a foot connected to the base and movable between a first position and a second position, the second position including arranging the foot to stabilize the base on the surface, wherein the foot is rotatable relative to the base between the first position and the second position.

21. The golf bag support according to claim 20, wherein the bottom of the base and a bottom of the foot are generally co-planar and define a footprint of the golf bag support, wherein the size of the footprint differs when the foot is in each of the first position and the second position.

22. The golf bag support according to claim 20, wherein the footprint of the golf bag in the second position is larger than the footprint of the golf bag in the first position.

23. The golf bag support according to claim 8, wherein the first member and second member are integral and define a continuous interior surface.

24. The golf bag support according to claim 8, wherein each arm defines an interior surface facing the interior surface of the other arm and wherein each surface is generally curvilinear.

* * * * *